US005490864A

United States Patent [19]

Herbstman et al.

[11] Patent Number: 5,490,864

[45] Date of Patent: Feb. 13, 1996

[54] ANTI-WEAR LUBRICITY ADDITIVE FOR LOW-SULFUR CONTENT DIESEL FUELS

[75] Inventors: Sheldon Herbstman, New City; Doris Love, Fishkill; Michael P. Petrus, Wappingers Falls; Cyril A. Migdal, Croton-On-Hudson, all of N.Y.

[73] Assignee: Texaco Inc., White Plains, N.Y.

[21] Appl. No.: 265,670

[22] Filed: Jun. 22, 1994

Related U.S. Application Data

[63] Continuation of Ser. No. 739,548, Aug. 2, 1991, abandoned.

[51] Int. Cl.[6] ..... C10L 1/26

[52] U.S. Cl. ..... 44/379

[58] Field of Search ..... 44/305, 379; 558/112, 558/113

[56] References Cited

U.S. PATENT DOCUMENTS

| | | | |
|---|---|---|---|
| 2,934,500 | 4/1960 | Cantrell et al. | 44/379 |
| 3,197,404 | 7/1965 | Berger et al. | 252/46.6 |
| 3,197,407 | 7/1965 | Cyba | 252/46.6 |
| 3,346,667 | 10/1967 | Firth | 44/305 |
| 3,544,465 | 12/1970 | Braid | 252/379 |
| 3,919,095 | 11/1975 | Okorodudu | 44/379 |
| 3,834,893 | 5/1989 | Doner et al. | 252/32.7 E |

*Primary Examiner*—Margaret Medley

[57] ABSTRACT

A diesel fuel composition which is comprised of:

(a) a major portion of a low-sulfur content diesel fuel; and (b) a minor amount, as an anti-wear lubricity additive, of a dithiophosphoric diester-dialcohol.

3 Claims, No Drawings

ANTI-WEAR LUBRICITY ADDITIVE FOR LOW-SULFUR CONTENT DIESEL FUELS

This is a continuation of U.S. application Ser. No. 07/739,548, filed on Aug. 2, 1991, now abandoned.

BACKGROUND OF THE INVENTION

This invention relates to diesel fuels, and more particularly to a low-sulfur content diesel fuel containing an anti-wear, lubricity additive.

In the use of diesel fuels, especially low sulfur content fuels, there is little protection against injector wear. The wear occurs to the injector needle due to rubbing contact with the surface of its container. The wear results in leaking injector fuel pumps. Also, various parts of fuel pumps such as internal gears and cams are subject to wear due to fuel related problems. Excess fuel in the combustion chambers, due to leaking injectors, causes fuel-rich environment with black smoke in the combustion gases.

Also, because of expanded future use of hydrotreated low sulfur diesel fuel for environmental reasons, wear problems with injectors and fuel pumps on trucks/cars will become more noticeable.

Lubricity additives are added to diesel fuel to protect against injector and pump wear. According to the present invention, it has been found that dithiophosphoric diester-dialcohol compounds are useful as anti-wear, lubricity additives in a low-sulfur content diesel fuel. This result was unexpected since it was thought that the lubricity additive in a diesel fuel would not be sufficiently thermally stable to withstand the high temperatures found in the needle valve area of direct injectors used in heavy duty diesel engines.

Thus, it is an object of the present invention to provide a means i.e., an additive, for protecting the moving parts of a diesel injector from wear during operation with a low-sulfur content diesel fuel.

DISCLOSURE STATEMENT

U.S. Pat. No. 2,568,784 discloses reaction products of olefin oxides and pentaoxide ($P_2O_5$) or phosphorous pentasulfide ($P_2S_5$) and the method of making such reaction products.

U.S. Pat. No. 3,197,404 discloses reaction products of phosphorus pentasulfide with epoxides and metal salts thereof and a method for preparing the same. It also discloses a liquid lubricating oil compositions containing these reaction products and salts.

U.S. Pat. No. 3,346,667 discloses compositions prepared by the simultaneous reaction of (1) phosphorus oxide or phosphorus sulfide, preferably phosphorus pentoxide, with (2) an oxyalkylating agent and (3) a compound embodying at least one hydroxyl group or other source of an active hydrogen atom e.g. thiol group.

U.S. Pat. No. 4,834,893 discloses phosphorodithioate substituted carboxylic anhydride or acid derivates and their corresponding metal salts which are effective multifunctional additives for various lubricants and fuels.

U.S. patent application No. 07/062,019 now abandoned discloses a diesel fuel injector detergent which comprises a solvent, an alcohol, an amino alkylene-substituted asparagine and an N-alkylalkylene diamine.

U.S. patent application No. 07/708/261, now abandoned and refiled as U.S. Ser. No. 08/274,106 discloses a method for producing an ashless, antiwear-antioxidant lubricating oil additive. The method comprises:

(a) reacting an alcohol with phosphorus pentasulfide to form a dithiophosphoric acid intermediate;
(b) treating the dithiophosphoric acid intermediate with a diexpoxide to yield a corresponding dithiophosphoric diester-dialcohol product; and
(c) recovering the diester-dialcohol product lubricant oil additive.

SUMMARY OF THE INVENTION

U.S. Patent

This invention provides a diesel fuel composition comprising:
(a) a major portion of a low-sulfur content diesel fuel; and
(b) a minor amount, as an anti-wear lubricity additive, of a dithiophosphoric diester-dialcohol represented by the formula

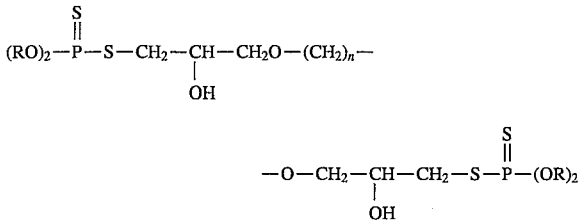

where R is a ($C_4$–$C_{18}$) alkyl normal or iso-radical; and n=1–5.

DETAILED DESCRIPTION OF THE INVENTION

Generally, diesel injectors in contact with low-sulfur diesel fuels tend to show considerable needle wear. Direct injectors are particularly prone to these type of problems because they operate under extremely high pressures of 3000 to 15000 psig. Normal diesel fuel with sulfur contents ranging from 0.25 to 0.5 percent offer some protection against metal wear because sulfur compounds act as a natural lubricant. Low sulfur hydrotreated fuels now coming on the market do not afford the same natural anti-wear lubricity protection.

According to the present invention, an anti-wear lubricity additive is added to the low-sulfur content diesel fuel which apparently coats the moving parts and thus protects the injector needle or fuel pump parts against wear.

The diesel fuel composition containing this lubricity additive comprises:
(a) a major portion of a low-sulfur content diesel fuel; and
(b) a minor amount, as an anti-wear lubricity additive, of a dithiophosphoric diester-dialcohol represented by the formula

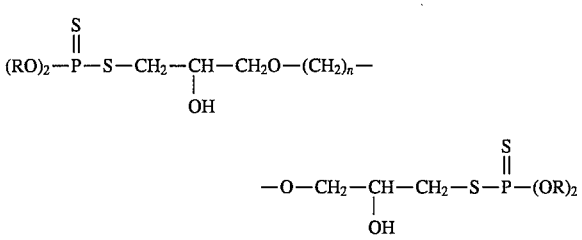

where R is a ($C_4$–$C_{18}$) alkyl normal or iso-radical; and n=1–5.

The amount of sulfur in the low-sulfur content diesel fuel ranges from about 0.01 to about 1.0%.

The diester-dialcohol is represented by the formula

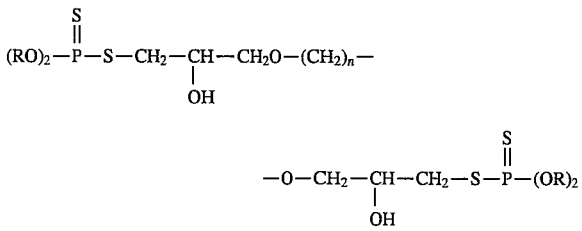

where R is an alkyl ($C_4$–$C_{18}$) normal or iso-radical including dodecyl, octadecyl and unsaturated material such as oleyl; and n=1–5.

The preferred diester-dialcohol is compound is wherein the formula, above, R is a mixture of $C_3$ and $C_6$ alkyl radicals and n=4.

In the diesel fuel composition, the amount of diester-dialcohol added to the low-sulfur content diesel fuel ranges from about 5 PTB to about 100 PTB, and preferably about to about 90 PTB.

In preparing the present anti-wear, lubricity additive, a bis-epoxide is reacted with diothiophosphoric acid to produce the additive as illustrated by the following reaction:

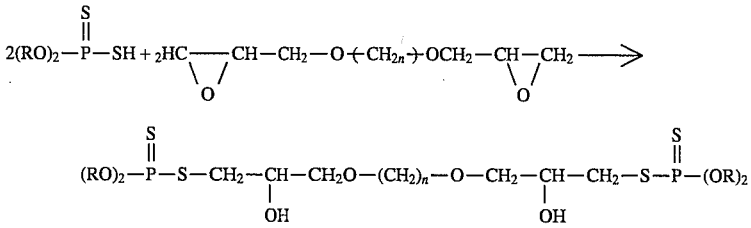

where R is a ($C_4$–$C_{18}$) alkyl normal or iso-radical; and n=1–5.

The advantages and the important features of the present invention will be more apparent from the following examples.

EXAMPLE I

Preparation of Dithiophosphoric Acid

The alcohol, or mixture of alcohols, was added to a slurry of $P_2S_5$ in heptane at 70° C. (158° F.). The mole ratio of alcohol to $P_2S_5$ was 4:1 but could be in a range of 5:1 to 3:1. The mixture was stirred one hour at 70° and then three hours at 80° C. Then, the unreacted $P_2S_5$ was filtered off.

EXAMPLE II

Reaction of Dithiophosphoric Acid(s) with Diepoxide

The dithiophosphoric acid or a mixture of dithiophosphoric acids was combined with the diepoxide at ambient temperature in a ratio of 2:1 but could be in a ratio of 0.5:1 to 2.5:1. The mixture was then stirred at 90° C. for three hours, vacuum stripped and filtered.

EXAMPLE III

In evaluating the present lubricity additive, the additive was added to a low-sulfur anti-wear,(0.01%) content diesel fuel and tested by the Four Ball Wear Test which is described below. The test was developed to measure the amount of wear achieved during point to point contact of the four balls under high load and rotational speed with the diesel fuel as a lubricant.

FOUR BALL WEAR TESTS

I. Purpose of Tests

To evaluate the anti-wear performance of oil and greases, and transportation fuels such as diesel.

II. Apparatus

The Four-Ball Wear Test machine is used. Four balls are arranged in an equilateral tetrahedron. The lower three balls are clamped securely in a test cup filled with lubricant and the upper ball is held by a chuck which is motor driven, causing the upper ball to rotate against the fixed lower balls. Load is applied in an upward direction through a weight/lever arm system. Loading is incremental (minimum increment is 1 kg) except for the Roxana tester which has a continuously variable loading system. Heaters allow operation at elevated oil temperatures. On some machines, a strain arm system and accompanying instrumentation allow measurement and recording of friction. With the exception of the Roxana machine, which has continuously variable speed control up to 3600 rpm, the test speeds available for each tester are 600 rpm, 1200 rpm and 1800 rpm.

III. Test Procedures

Three stationary steel balls are immersed in the diesel fuel and the fourth steel ball is rotated on top of the three stationary balls and making point to point contact. Time is 1 hr, temperature is room temperature, load is 5000 g (5 Kg), rotational speed is 1800 rpm. The various properties and information of the materials used in the tests are provided below in Table 1.

TABLE 1

| Properties of Low-Sulfur Content Diesel Fuel | |
|---|---|
| % S | .05 |
| % Ash | <.001 |
| Kin Vis @ 40 | 1.93 |
| ASTM Color | 0.5 |
| Cloud Pt | −12° C. |
| Pour Pt | −21° C. |
| Aniline Pt | 154.9° F. |
| Flash °C. | 85 (185° F.) |
| Water | None |
| Sediment wt. % | None |
| FIA, Aromatics, Test, Vol % | |
| Aromatics | 22.0 |
| Olefins | 3.0 |
| Saturates | 75.0 |
| Distillation, Vol-%, °F. | |
| IBP | 397 |
| 5 | 417 |
| 10 | 420 |
| 20 | 430 |

TABLE 1-continued

| | |
|---|---|
| 30 | 439 |
| 40 | 450 |
| 50 | 463 |
| 60 | 481 |
| 70 | 505 |
| 80 | 537 |
| 90 | 583 |
| 95 | 616 |
| EP | 649 |

After testing, it was concluded that the dithiophosphoric diester-dialcohol of the present invention was very effective as a lubricity agent when introduced to the low-sulfur content diesel fuel.

The following are the summaries of the results of the Four Ball Wear Tests where the base diesel fuel was 0.05% sulfur content diesel fuel and the dithiophosphoric diesterdialcohol used was prepared as in Example IV, below.

The following "Four-Ball" Wear Test data shown below in Table 2 was obtained comparing an additized fuel comparing the present diester-dialcohol additive at 30, 60 and 90 PTB to base fuel.

TABLE 2

Four-Ball Test Data*
Scar Diameter, mm
Low Sulfur (0.05%) Base Fuel

| Base Fuel | Present Additive | |
|---|---|---|
| mm | PTB | mm |
| 0.53 | 30 | 0.23 |
| 0.54 | 60 | 0.24 |
| 0.62 | 90 | 0.19 |

*Test run conditions-Run time- 1 Hour, temperature-room temperature, load 5000 g, rotational speed 1800 rpm.

Thus, in the data shown, above the additized diesel fuel containing the present anti-wear, lubricity additive shows significantly reduced wear over that of the base fuel.

EXAMPLE IV

Preparation of Dithiophosphoric Diester-Dialcohol Additive 104 grams (0.250 m) $P_2S_5$ acid from MIBC and 97.0 grams (0.25 m) $P_2S_5$ acid from IPA combined and added to 84.2 grams (0.25 m), 1,4-butanediol diglycidyl ether (60% in water) at ambient temperature. The reaction mixture was stirred at 90° C. for 3 hours, solvent stripped under vacuum and filtered to yield 180 grams (Theory: 181 grams) product. The product contained 15.5% sulfur (Theory: 17.7).

We claim:

1. A diesel fuel composition comprising:

(a) a low-sulfur content diesel fuel having a sulfur content from about 0.01 to about 1.0%; and (b) from about 5 PTB to about 100 PTB, as an anti-wear lubricity additive, of a dithiophosphoric diesterdialcohol represented by the formula:

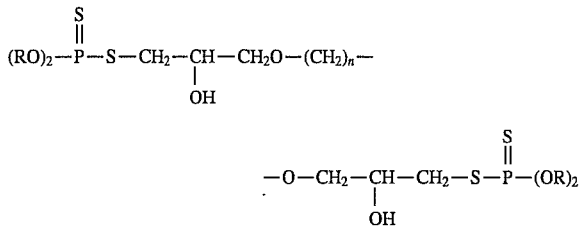

where R is a ($C_4$–$C_{18}$) alkyl normal or iso-radical, and n=1–5.

2. The diesel fuel composition of claim 1, wherein said R is a $C_{12}$ alkyl radical or octadecyl.

3. The diesel fuel composition of claim 1, wherein the amount of dithiophosphoric diester-dialcohol added to said diesel fuel ranges from about 30 to about 90 PTB.

* * * * *